US011524874B2

(12) United States Patent
Montigny et al.

(10) Patent No.: US 11,524,874 B2
(45) Date of Patent: Dec. 13, 2022

(54) ELEVATOR CAR WITH MECHANICAL ASSISTANCE FOR WORKING PLATFORM

(71) Applicant: Otis Elevator Company, Farmington, CT (US)

(72) Inventors: Guillaume Montigny, Gien (FR); Frederic Beauchaud, Coullons (FR); Joachim Angoulevant, Saint Martin d'Abba (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/952,476

(22) Filed: Nov. 19, 2020

(65) Prior Publication Data

US 2021/0155458 A1 May 27, 2021

(30) Foreign Application Priority Data

Nov. 26, 2019 (EP) ..... 19315148

(51) Int. Cl.
*B66B 11/02* (2006.01)

(52) U.S. Cl.
CPC ..... *B66B 11/0246* (2013.01)

(58) Field of Classification Search
CPC ..... B66B 11/0246; B66B 5/0087
See application file for complete search history.

(56) References Cited

U.S. PATENT DOCUMENTS 6,202,800 B1 * 3/2001 Muller ..... B66B 11/0246 187/401
6,202,801 B1 * 3/2001 Muller ..... B66B 11/0246 187/269
6,273,216 B1 * 8/2001 Kocher ..... B66B 5/027 187/377
6,419,052 B1 * 7/2002 Muller ..... B66B 11/0246 187/414
6,691,833 B1 * 2/2004 Elsener ..... B66B 5/288 187/266
6,880,678 B1 * 4/2005 Schneider ..... B66B 11/0246 187/314

(Continued)

FOREIGN PATENT DOCUMENTS

EP 1533265 A1 5/2005
JP H09263372 A 10/1997

OTHER PUBLICATIONS

European Search Report for Application No. 19315148.7; dated Jun. 17, 2020; 6 Pages.

*Primary Examiner* — Michael A Riegelman
(74) *Attorney, Agent, or Firm* — Cantor Colburn LLP

(57) ABSTRACT

An elevator car (1) defining an interior space (2) for accommodating passengers and/or cargo. The elevator car (1) includes a working platform (12) moveable between a stowed position, above the interior space (2), and an operational position, suspended within the interior space (2), a hoisting device (18) located at the working platform (12) and a tension member (16*a*, 16*b*) connected to the hoisting device (18) and connected to the working platform (12) such that a suspending portion (17*a*, 17*b*) of the tension member (16*a*, 16*b*) suspends the working platform (12). The hoisting device (18) is configured, when actuated, to alter the length of the suspending portion (17*a*, 17*b*), so as to hoist the working platform (12) between the stowed position and the operational position.

12 Claims, 7 Drawing Sheets

(56) References Cited

U.S. PATENT DOCUMENTS

| | | | | |
|---|---|---|---|---|
| 7,337,880 | B2 * | 3/2008 | Sittier | B66B 11/0246 187/401 |
| 9,193,566 | B1 * | 11/2015 | Nieves | B66B 11/0226 |
| 9,546,078 | B2 * | 1/2017 | Paasisalo | B66B 11/0226 |
| 11,091,352 | B2 * | 8/2021 | Fauconnet | B66B 11/0206 |
| 11,104,550 | B2 * | 8/2021 | Fernandez | B66B 11/0246 |
| 2006/0289244 | A1 * | 12/2006 | Sittier | B66B 11/0246 187/401 |
| 2007/0056809 | A1 * | 3/2007 | Fernandes | B66B 11/0246 187/401 |
| 2007/0056810 | A1 * | 3/2007 | Fernandes | B66B 5/00 187/401 |
| 2019/0226217 | A1 * | 7/2019 | Foley | E04G 1/34 |
| 2019/0263629 | A1 * | 8/2019 | Fernandez | B66B 11/0246 |
| 2019/0300338 | A1 * | 10/2019 | Rocher | B66B 13/06 |
| 2019/0330023 | A1 * | 10/2019 | Fauconnet | B66B 11/0246 |
| 2019/0330024 | A1 * | 10/2019 | Durand | B66B 11/0025 |
| 2019/0389698 | A1 * | 12/2019 | Jimenez-Gonzalez | B66B 11/0246 |
| 2020/0277163 | A1 * | 9/2020 | Fauconnet | B66B 5/005 |
| 2020/0277164 | A1 * | 9/2020 | Fauconnet | B66B 19/00 |
| 2021/0002104 | A1 * | 1/2021 | Fauconnet | B66B 5/0087 |
| 2021/0061616 | A1 * | 3/2021 | Fauconnet | B66B 5/0062 |
| 2021/0155458 | A1 * | 5/2021 | Montigny | B66B 11/0246 |
| 2021/0269279 | A1 * | 9/2021 | Talonen | B66B 11/0246 |
| 2021/0269283 | A1 * | 9/2021 | Siironen | B66B 11/0246 |

* cited by examiner

ELEVATOR CAR WITH MECHANICAL ASSISTANCE FOR WORKING PLATFORM

FOREIGN PRIORITY

This application claims priority to European Patent Application No. 19315148.7, filed Nov. 26, 2019, and all the benefits accruing therefrom under 35 U.S.C. § 119, the contents of which in its entirety are herein incorporated by reference.

TECHNICAL FIELD

This disclosure relates to an elevator car with a working platform used to carry out maintenance from inside an elevator car. In particular, this disclosure relates to an elevator car and method of moving a working platform with mechanical assistance.

BACKGROUND

It is known to provide working platforms located in or above the ceiling of elevator cars, which are moveable between a stowed position and an operational position. In the operational position, the working platform is located within the elevator car, at such a height that a maintenance person is able to stand on the working platform and access elevator components through an opening in the elevator car ceiling. Typically a maintenance person must move such a working platform manually between the stowed and operational positions. This often requires the maintenance person to exert a large amount of force on the working platform to push it back up to the stowed position, and to be careful when lowering the working platform to prevent a sudden drop or freefall of the working platform. The working platform may weigh up to 60 kg.

It would be desirable to provide a maintenance person with mechanical assistance when operating a working platform in an elevator car.

SUMMARY

According to a first aspect of this disclosure there is provided an elevator car defining an interior space for accommodating passengers and/or cargo, the elevator car comprising: a working platform moveable between a stowed position, above the interior space, and an operational position, suspended within the interior space; a hoisting device located at the working platform; a tension member connected to the hoisting device and connected to the working platform such that a suspending portion of the tension member suspends the working platform, wherein the hoisting device is configured, when actuated, to alter the length of the suspending portion, so as to hoist the working platform between the stowed position and the operational position.

According to a second aspect of this disclosure there is provided a method of moving a working platform of an elevator car between a stowed position, above an interior space for accommodating passengers and/or cargo, defined by the elevator car, and an operational position, suspended within the interior space, wherein the elevator car comprises a tension member connected to a hoisting device and connected to the working platform such that a suspending portion of the tension member suspends the working platform; the method comprising: actuating the hoisting device to alter the length of the suspending portion, so as to hoist the working platform between the stowed position and the operational position.

It will be appreciated that, according to the present disclosure, the hoisting device is able to move the working platform between the operational position and the stowed position, when actuated, in a controlled manner which requires minimal exertion by a maintenance person, thereby providing improved handling of the working platform. This means that a maintenance person does not need to push the working platform up to the stowed position unassisted i.e. the maintenance person does not need to apply a large upwards force to overcome the whole weight of the working platform. Rather, the maintenance person can adjust the length of the suspending portion of the tension member and thereby move the working platform from the operational position to the stowed position without actually having to lift the working platform.

It will furthermore be appreciated that the location of the hoisting device at the working platform is advantageous since a maintenance person is able to easily access the hoisting device from inside the elevator car, even when the working platform is in the stowed position, and thus deployment of the working platform is both easy and convenient for the maintenance person. In some examples the hoisting device is attached to the working platform. Preferably the hoisting device is attached to an underside of the working platform. This allows the hoisting device to be stored discreetly and prevents the hoisting device from taking up useful space on the working platform or within the elevator car, whilst also being very easily accessible to a maintenance person from within the elevator car. Optionally, the tension member may be arranged to pass through or round the working platform to connect the hoisting device.

It will be understood by the skilled person that the statement that the tension member is "connected" to the working platform describes not only the case in which one or both ends of the tension member are fixed e.g. hitched to the working platform, but also any other suitable arrangement in which the tension member passes through, under, or around the working platform, in a manner which allows the suspending portion of the tension member to suspend the working platform. For example, the tension member could undersling the working platform. In examples in which the hoisting device is attached to the working platform, the tension member may be indirectly connected to the working platform by virtue of being connected to the hoisting device which is itself attached to the working platform.

In some examples, in addition or alternatively, the tension member connects the hoisting device to a connection point which moves relative to the working platform as the working platform is moved between the stowed position and the operational position. The connection point may be a fixed point in the elevator car, for example a connection point on a support frame located at an upper part of the elevator car, or a connection point on a wall of the elevator car.

In some examples, in addition or alternatively, the hoisting device maintains the suspending portion of the tension member at a given length, unless actuated by the application of a force i.e. the hoisting device is self-locking. This helps to improve the safety of the working platform, since this means that whenever a maintenance person has been moving the working platform using the hoisting device, and then ceases to actuate the hoisting device, the working platform will remain stationary at the height to which it had been moved, and will not begin to rise up, or fall down independently i.e. of its own accord. If the maintenance person stops the actuation then the hoisting device will lock in its current position, so that the risk of the working platform freefalling is significantly reduced. This helps the working platform to be both moved to the operational position and stowed smoothly and with minimal risk to a maintenance person, since this self-locking helps to prevent a possible safety hazard caused by this unexpected movement. Moreover, this helps to reduce the need to provide locking devices in order to fix the working platform in certain positions e.g. no locking mechanism may be required to fix the working platform in the stowed position or operational position, or any position in between, since it will be maintained in a given position by the hoisting device, unless the hoisting device is actuated. However, in one or more examples it may still be desirable for the elevator car to include a locking means for the working platform at least in the stowed position, e.g. for increased peace of mind and a safety back-up.

It will furthermore be understood by the skilled person that the hoisting device may be any suitable device which is able to alter the length of the suspending portion as described, i.e. the hoisting device is a device which is configured to gather in (or out) or wind in (or out) the length of the tension member, so as to alter the length of the suspending portion.

The hoisting device may, for example, comprise an electrical motor arranged to wind the tension member around a collector (such as a drum). In some examples, the hoisting device may comprise a gas spring arranged to alter the length of the suspending portion. In some examples, the hoisting device may comprise a reduction gear assembly, or any other suitable mechanical device operable to alter the length of the suspending portion. In any of these examples, the hoisting device may be operated automatically or manually.

In some examples, in addition or alternatively, the hoisting device is rotationally driven to alter the length of the suspending portion e.g. thereby acting to hoist the working platform between the stowed position and the operational position. This allows rotational motion (applied automatically or by a maintenance person) to be converted into a relative shortening (or lengthening) of the suspending portion of the tension member, which thereby results in the working platform being lifted towards the stowed position, or lowered towards the operational position.

In some examples, in addition or alternatively, the hoisting device comprises a worm screw and a sliding member configured to slide along the worm screw when the worm screw is rotationally driven. The tension member is connected to the sliding member, such that when the sliding member moves the length of the suspending portion is altered. For example, as the worm screw is rotated, the sliding member moves the tension member and alters the length of the suspending portion. In at least some examples, the tension member is connected to the sliding member via one or more deflectors. Optionally, the deflectors may be deflection sheaves, for ease of running of the tension member. In at least some examples, the one or more deflectors are arranged to at least partially wind up the tension member as the sliding member moves in a first direction, thereby shortening the length of the suspending portion. The sliding member may be a worm gear in at least some examples. An end of the tension member may terminate at the sliding member.

The sliding member may comprise a hole, sized to receive the worm screw. The hole may comprise a plastic ring. The plastic ring may be self-lubricating. The hoisting device may further comprise an elongate rod, parallel to the worm screw and arranged to pass through the sliding member, wherein the sliding member is configured to slide along the elongate rod. This helps to provide stability to the hoisting device.

In some examples, in addition or alternatively, the pitch angle of the worm screw is 8 mm or less. This helps to make the worm screw self-locking at small increments of movement, such that the worm screw (hence the sliding member and therefore the working platform) will not move unless further force is applied to the worm screw to alter the length of the suspending portion again.

In one or more examples wherein the hoisting device is rotationally driven, the hoisting device may be driven directly, e.g. using a motor as a rotational drive. The motor may be operated automatically or manually. For example, the motor may be provided by a drill that is manually operated to drive the hoisting device (e.g. using a drill to turn the worm screw in some examples). The use of a drill reduces the exertion required by the maintenance person.

In one or more other examples, the hoisting device may be driven indirectly, e.g. using a crank connected to a rotating drive shaft. In at least some examples where the hoisting device comprises a worm screw, as discussed above, the hoisting device may further comprise a crank arranged to drive rotation of the worm screw. The crank may not be a permanent part of the hoisting device, but rather may be a separate tool stored at a location within the elevator system, for example under the working platform or in a cabinet on a landing floor of the elevator system. A crank provides a simple mechanism by which a maintenance person is able to actuate the hoisting device, in particular when standing in the elevator car below the working platform. Furthermore, the use of a crank is advantageous since cranks are often provided as a standard elevator maintenance tool and are often stored within the elevator car and hence are likely to be easily accessible to a maintenance person.

In examples of the method disclosed herein, the step of actuating the hoisting device may comprise manually actuating the hoisting device, e.g. using a crank.

Normally a crank is connected to a rotating drive shaft at 90°. However, it has been recognised than when a person is standing below the working platform to operate the crank, it may be desirable for the crank to extend at an angle of more than 90°. This means that the crank does not hang down and potentially hit a user, as well as making it easier to operate. In at least some examples, the crank is arranged to extend at an angle of between 120° and 150° from the axis defined by the worm screw, and optionally at an angle of around 135°. This helps to protect the technician from harm and provides a good angle of approach for operating the crank. In order to prevent the crank from hanging down at an angle of 90° from the axis of the worm screw, the hoisting device may comprise a bracket arranged to limit the angle at which the crank extends.

More generally, manual actuation is desirable when a maintenance person is working in the car and thus in various examples the hoisting device may be manually actuatable. This means that a maintenance person can autonomously control the raising and/or lowering of the working platform.

In some examples in addition or alternatively, the hoisting device comprises at least one deflector such as a deflection sheave, and the tension member is arranged to pass over the at least one deflector. In some examples, the tension member could be arranged in a 1:1 roping ratio with the hoisting device, such that the length of rope which is hoisted e.g. wound or gathered, by the hoisting device is equal to the change in length of the suspending portion of the tension member. However, preferably the tension member is arranged in a higher roping ratio with the hoisting device, for example a 2:1 roping arrangement, a 3:1 roping arrangement, or a 4:1 roping arrangement. In at least some examples, the hoisting device comprises at least one deflector, and the tension member is arranged to pass over the at least one deflector in a 3:1 roping arrangement. For explanation, in a 3:1 roping arrangement the deflector(s) are arranged such that for one unit of movement of the hoisting device, the suspending portion of the tension member is altered in length three times as far.

In some examples, in addition or alternatively, the elevator car further comprises a support frame located at an upper part of the elevator car and a connection mechanism, the connection mechanism connected to the support frame and connected to the working platform. The support frame may be arranged to suspendably connect the working platform to the support frame, i.e. in addition to the suspension provided by the at least one tension member. The connection mechanism helps to provide stability to the working platform in the operational position, and as it moves between the stowed position and the operational position. The connection mechanism thus provides a connection from the support frame to the working platform. In some examples, the connection mechanism is arranged to exclusively support the weight of the working platform in the operational position. The connection mechanism may be such that it only allows the working platform to be lowered to a set height i.e. the height of the operational position. The length of the tension member may provide sufficient excess such that the suspending portion of the tension member can be lengthened to greater than the length required to reach the operational position i.e. allowing the tension member to go slack when the working platform is in the operational position. This helps to provide an arrangement in which the tension member is not required to bear the full weight of the working platform and any additional load e.g. of a maintenance person, when the working platform is in use in the operational position. This means that a smaller, lower load bearing tension member could potentially be used, and also helps to reduce wear and strain on the tension member.

In some examples, in addition or alternatively, the connection mechanism is a scissor mechanism. This provides a particularly simple and stable connection mechanism. In some examples the tension member passes through an intersection point of the scissor mechanism and connects to the support frame. This helps to provide improved stability.

In other examples, in addition or alternatively, the tension member is connected to an intersection point of the scissor mechanism. In this case, for each unit of movement of the hoisting device, the length of the suspending portion will be reduced by twice as much, compared to the case in which the tension member is connected to the support frame, because of the action of the scissor mechanism, and this therefore provides an improved roping arrangement.

In various examples of the present disclosure, the tension member is a flexible member, for example a flexible rope, cable or belt.

In some examples, in addition or alternatively, the elevator car comprises a first tension member and a second tension member, each of the first and second tension members connected independently to the hoisting device and to the working platform. This provides for redundancy in case of failure of one of the tension members. In at least some examples, in addition or alternatively, the elevator car comprises a first tension member arranged at a first side of the working platform and a second tension member arranged at a second side of the working platform, wherein the second side is an opposing side of the working platform to the first side. This provides a more balanced suspending force acting on the opposing sides of the working platform, such that each of the opposing sides is lifted by the hoisting device approximately equally, allowing the working platform to remain approximately level as it is moved between the operational position and the stowed position and thereby providing smooth movement of the working platform.

There is also disclosed an elevator system comprising an elevator car according to any of the examples disclosed herein.

BRIEF DESCRIPTION OF THE DRAWINGS

Certain preferred examples of this disclosure will now be described, by way of example only, and with reference to the accompanying drawings, in which.

DETAILED DESCRIPTION

Figure 1C:
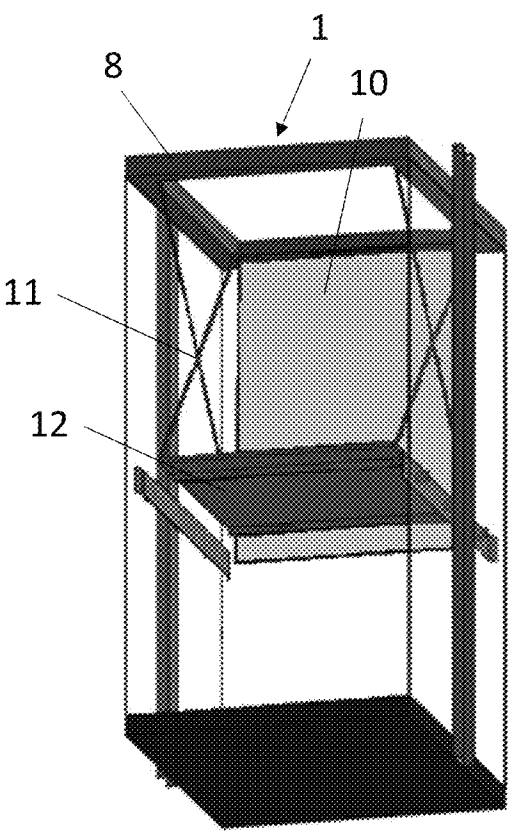
FIGS. 1*a*, 1*b* and 1*c* are cutaway schematic views of an elevator car including a working platform, moveable between a stowed position (as shown in FIGS. 1*a* and 1*b*) and an operational position (as shown in FIG. 1*c*)
Figure 1B:
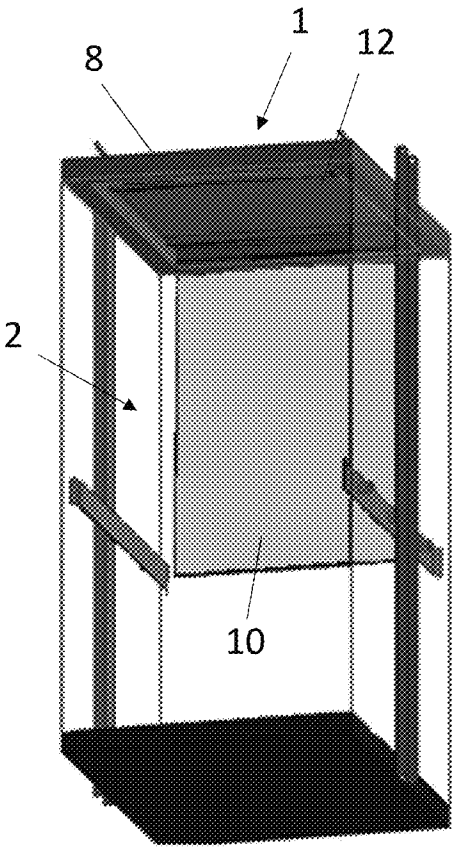
Figure 1A:
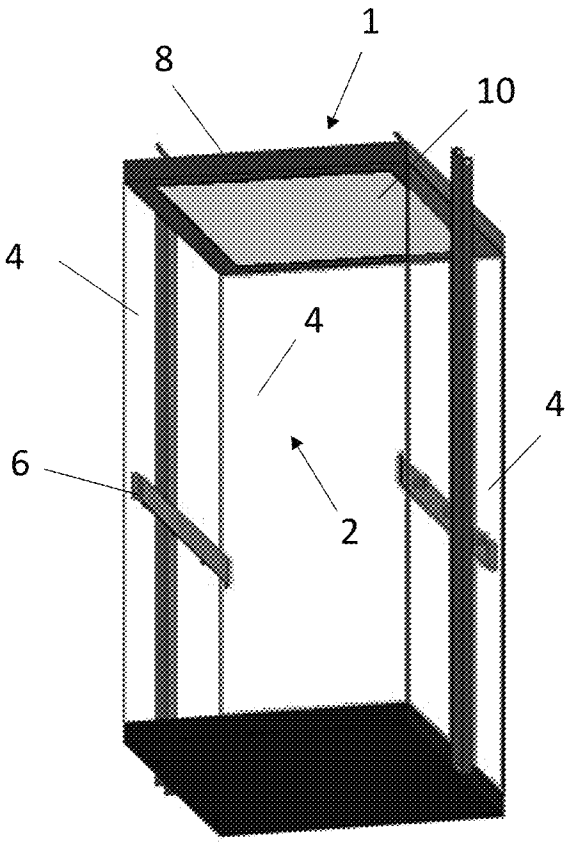

FIG. 1*a* shows a view of an elevator car 1, which defines an interior space 2. The elevator car 1 has side walls 4 surrounding the interior space 2. Above the interior space 2 there is a support frame 8, beneath which there is pivotably attached a decorative ceiling cover panel 10. In this arrangement, as shown in FIG. 1*a*, a passenger located within the interior space 2 of the elevator car 1, sees the decorative ceiling cover panel 10 as covering the vast majority, or even the entirety of the elevator car ceiling, such that the support frame 8 is not normally visible.

FIG. 1*b* shows the elevator car 1 of FIG. 1*a*, in which the decorative ceiling cover panel 10 has been pivoted down to an open position. The elements of FIGS. 1*b* and 1*c*, which are already labelled in FIG. 1*a*, and can easily be identified as such by the skilled person, have not been labelled again in FIGS. 1*b* and 1*c* so as to improve the clarity of the drawings. Although FIG. 1*b* shows the decorative ceiling cover panel 10 as having been hinged open, from a pivot point in the elevator car ceiling, it is equally possible that the decorative ceiling cover panel 10 could be fixed in place by any other suitable mechanism, such as for example screws or clips, and could then be removed entirely from the ceiling of the elevator car 1 in order to expose the support frame 8.

Once the decorative ceiling cover panel 10 has been pivoted down or removed, the working platform 12 is then visible, located within the support frame 8 above the interior space 2 of the elevator car 1. In the elevator car as shown in FIG. 1*b*, the working platform 12 is still in the stowed positon, but is now accessible such that a maintenance person can move the working platform 12 from the stowed position shown in FIG. 1*b*, to the operational position, as shown in FIG. 1*c*.

As is most clearly seen in FIG. 1*c*, a connection mechanism 11 is arranged to suspendably connect the working platform 12 to the support frame 8. In this example, the connection mechanism 11 is a scissor mechanism. The scissor mechanism 11 opens out to allow the working platform 12 to be suspended within the interior space 2. The connection mechanism 11 can be any suitable mechanism which allows the working platform 12 to be moved between the stowed position and the operational position, and is able to adequately support the working platform 12 (together with any load carried in use) in its operational position.

As shown in FIG. 1*c*, the working platform 12 can be lowered from the stowed position into the interior space 2 of the elevator car. This lowered position of the working platform 12 is referred to herein as the operational position. It is in this position that a maintenance person can use the working platform 12 to stand on, and thereby access parts of the elevator system through the open ceiling for maintenance purposes. The height of the working platform 12 in the operational position is ideally 1.0 m or 1.1 m below the support frame 8, such that a maintenance person standing fully upright on the working platform 12 will protrude out of an opening in the ceiling of the elevator car 1 as provided by the support frame 8. The working platform 12 has a top surface 13 (seen in FIG. 2) and an underside 14 (seen in FIG. 3).

The connection mechanism 11 supports the working platform 12 in the operational position, and is able to bear the weight both of the working platform 12 and the weight of a maintenance person and any tools (up to a certain recommended maximum weight). In the absence of the hoisting device according to the present invention, a maintenance person would have to manually lower the working platform 12 from the stowed position, as shown in FIG. 1*a*, to the operational position, as shown in FIG. 1*c*. The connection mechanism 11 does not provide any resistance to this motion and so the maintenance person would need to support some of the weight of the working platform 12 as it was lowered, in order to prevent a sudden drop of the working platform 12 which would risk injury to the maintenance person and/or damage to the elevator car. In order to return the working platform 12 from the operational position to the stowed position, the maintenance person would have to push the working platform 12 upwards against its weight. However, the working platform 12 may weigh as much as 60 kg and so this can require the maintenance person to exert a large amount of upwards force, which is undesirable due to health and safety considerations.

According to examples of the present disclosure there is provided a hoisting device, which, when actuated by a maintenance person, changes the length of a suspending portion of a tension member, thereby hoisting or lowering the working platform as required, and thus helping the maintenance person to move the working platform 12 between the operational and stowed positions, in a controlled manner and without having to support its weight.

Figure 3:
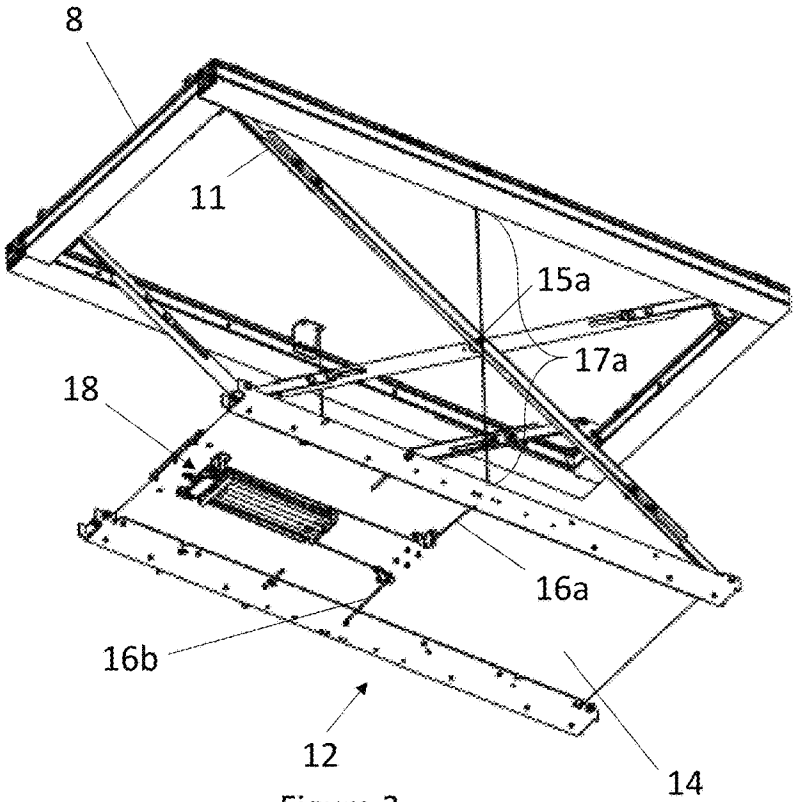
FIG. 3 is a perspective view of a working platform according to this example of the present disclosure, in the operational position, in which the underside of the working platform is visible.
Figure 2:
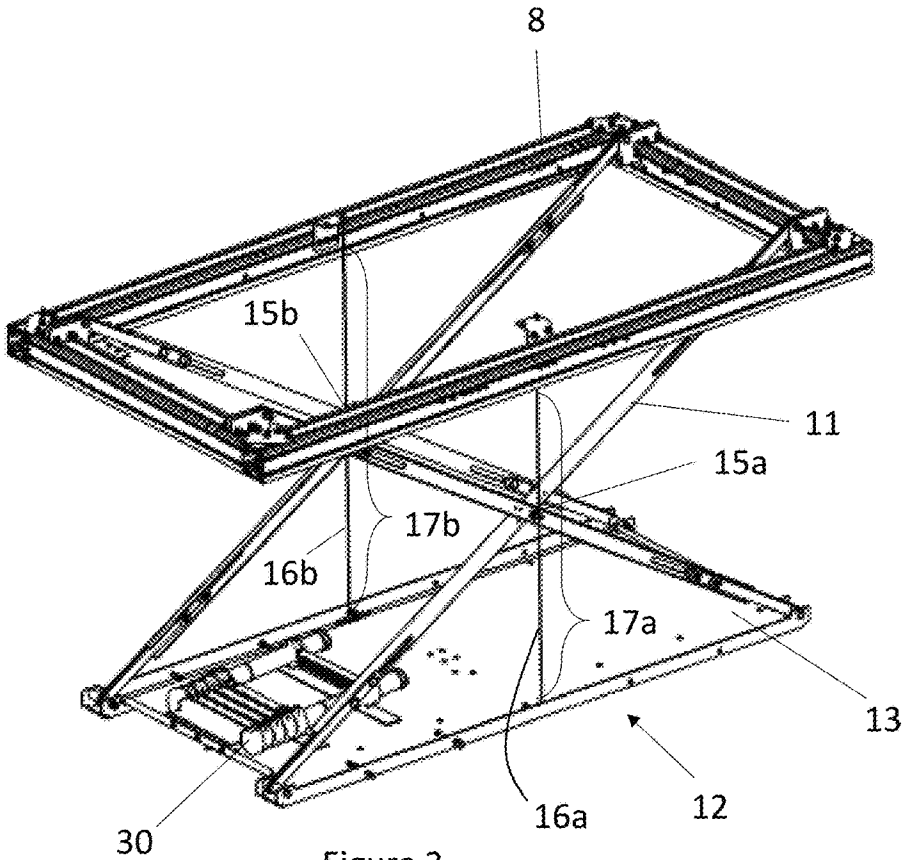
FIG. 2 is a perspective view of a working platform according to an example of the present disclosure, in the operational position, in which the top surface of the working platform is visible.

FIGS. 2 and 3 show a working platform 12 according to an example of the present disclosure. The working platform 12 is in the operational position. In FIG. 2 the top surface 13 of the working platform 12 is visible, in FIG. 3 the underside 14 of the working platform 12 is visible. In addition to the connection mechanism 11, the working platform 12 is also connected to the support frame 8 by a first tension member 16*a* and a second tension member 16*b*, although as described above, these tension members could be connected instead to an intersection point of the connection mechanism 11. The first tension member 16*a* is close to a first side of the working platform 12, and the second tension member 16*b* is close to a second, opposing side of the working platform 12. In this example, the first tension member 16*a* passes through the intersection point 15*a*, or apex, of the connection mechanism 11. The second tension member 16*b* passes through the intersection point 15*b*, or apex, of the connection mechanism 11. The working platform 12 includes a ladder 30, which a maintenance person can fold down in order to climb up onto the working platform 12.

Each tension member 16*a*, 16*b* is connected to the support frame 8 at a first end of the respective tension member 16*a*, 16*b*. The second end of each tension member 16*a*, 16*b* is connected to a hoisting device 18 according to the present disclosure, as shown in FIG. 3. Each tension member 16*a*, 16*b* includes a suspending portion 17*a*, 17*b* between the support frame 8 and the working platform 12, which is suspending the working platform 12, or would be if it were not for the connection mechanism 11. In the example as shown, each suspending portion 17*a*, 17*b* is substantially vertical. The hoisting device 18 is shown in more detail in FIG. 4.

Figure 4:
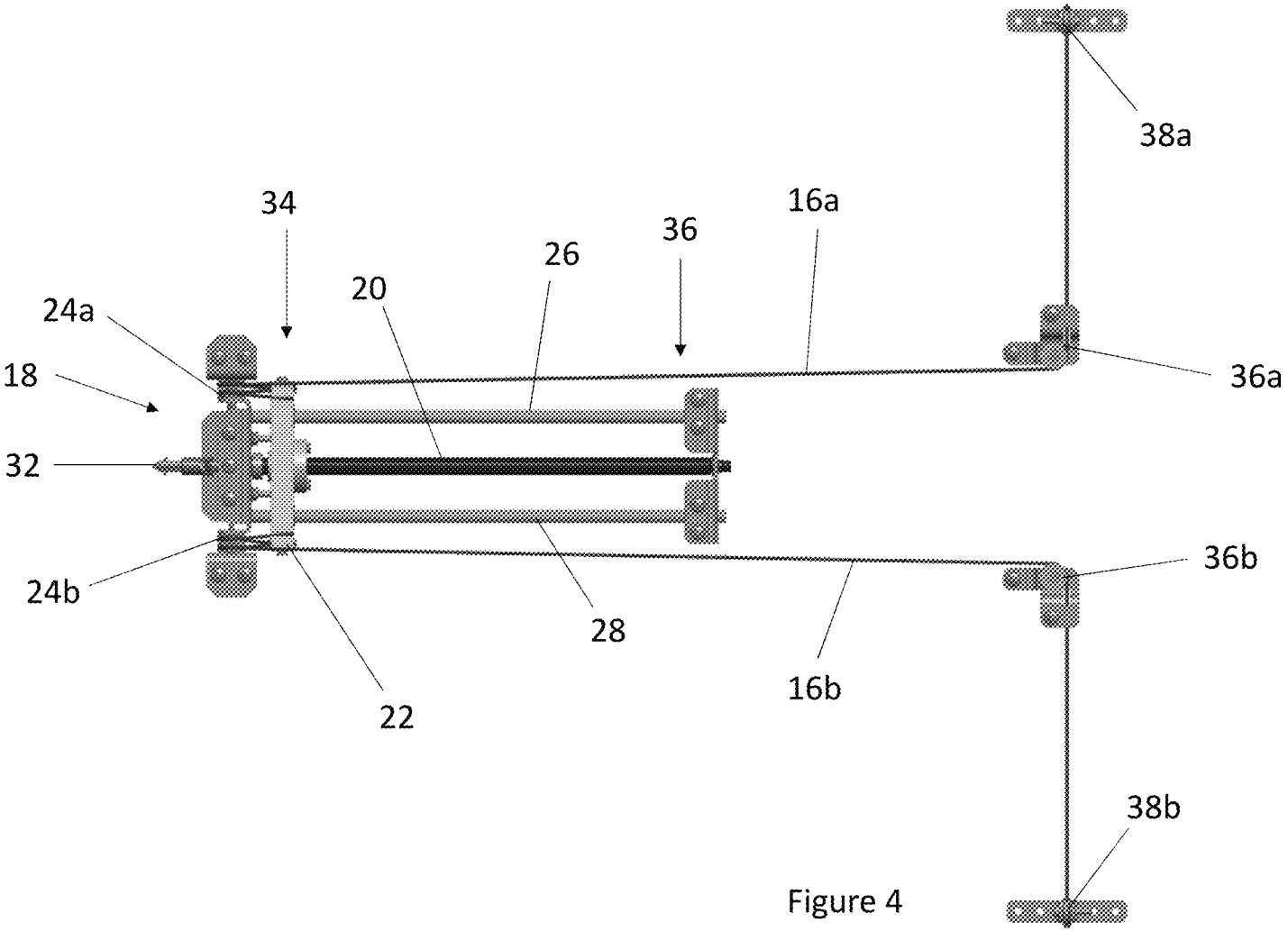
FIG. 4 is a plan view of the hoisting device according to this example of the present disclosure, when the working platform is in the operational position.

FIG. 4 shows the arrangement of the hoisting device 18 when the working platform 12 is in the operational position, as shown in FIGS. 2 and 3. In this example, the hoisting device 18 includes a worm screw 20 and a sliding member 22. The mechanism of a worm screw is such that as the worm screw 20 is turned, by means of end connection 32, the sliding member 22 slides along the worm screw 20. The direction (left or right, as viewed in FIG. 4) in which the sliding member 22 moves is determined by the direction of rotation of the worm screw 20. By the meshing of the thread of the worm screw 20 and the corresponding worm gear within the sliding member 22, the rotational motion of the worm screw 20 is converted into longitudinal motion of the sliding member 22. The thread angle (pitch angle) and thread depth of the worm screw are chosen such that the worm screw is self-locking i.e. so that if a maintenance person stops turning the worm screw 20 then the worm screw 20 will remain stationary and so will the sliding member 22. Thus the working platform 12 will remain stationary as long as the worm screw is not turned i.e. actuated (unless of course, the working platform is moved by a different means e.g. manually lifted). This allows the working platform 12 to be raised or lowered to intermediate positions, and then held there without requiring effort from the maintenance person. Often a locking mechanism is included at the support frame 8, to allow the working platform 12 to be locked in the stowed position. However, using the hoisting device 18 of the present invention, the working platform 12 can be locked in the stowed position without use of such an additional locking mechanism, simply using the self-locking of the hoisting device.

The sliding member 22 includes a hole which is configured to receive the worm screw and act as a worm-gear i.e. convert rotational motion of the worm screw into longitudinal motion of the sliding member 22 along the worm screw 20. The hole which receives the sliding member 22 is a plastic self-lubricating ring comprising grooves, which provide the worm-gear mechanism. This allows for easy movement of the sliding member 22 along the worm screw 20.

The hoisting device 18 also includes a first elongate rod 26 and second elongate rod 28. The sliding member 22 is arranged to slide along these rods 26, 28 as it moves along the worm screw 20. These rods 26, 28 are smooth so that the sliding member 22 can slide smoothly along them, as it moves, but help to provide stability to the sliding member 22 and prevent it from twisting.

The hoisting device 18 also includes a first deflection sheave 24*a* and a second deflection sheave 24*b*. As shown, when the working platform 12 is in the operational position, the sliding member 22 is close to a first end 34 of the worm screw, the end which is nearer to the first and second deflection sheaves 24*a*, 24*b*. The first end 34 is also nearer to the end connection 32. When the sliding member 22 is at this first end, very little of the tension members 16*a*, 16*b*, is passing back and forth between the respective deflection sheaves 24*a*, 24*b* and the sliding member 22, and therefore the remaining length of the tension members 16*a*, 16*b* i.e. the length of the suspending portion 17*a*, 17*b* (not shown in FIG. 4) which is suspending the working platform, is long.

The hoisting device 18 furthermore includes a third deflection sheave 36*a* and a fourth deflection shave 36b. These deflection sheaves 36*a*, 36*b* direct the tension members 16*a*, 16*b* towards the outer edges of the working platform 12, to intersection points 38*a*, 38*b*. At these intersection points, the respective tension members 16*a*, 16*b* pass through the working platform 12. The portion of each tension member 16*a*, 16*b* which is the other side of the intersection point 38*a*, 38*b* (not shown) is the suspending portion 17*a*, 17*b*.

Figure 6:
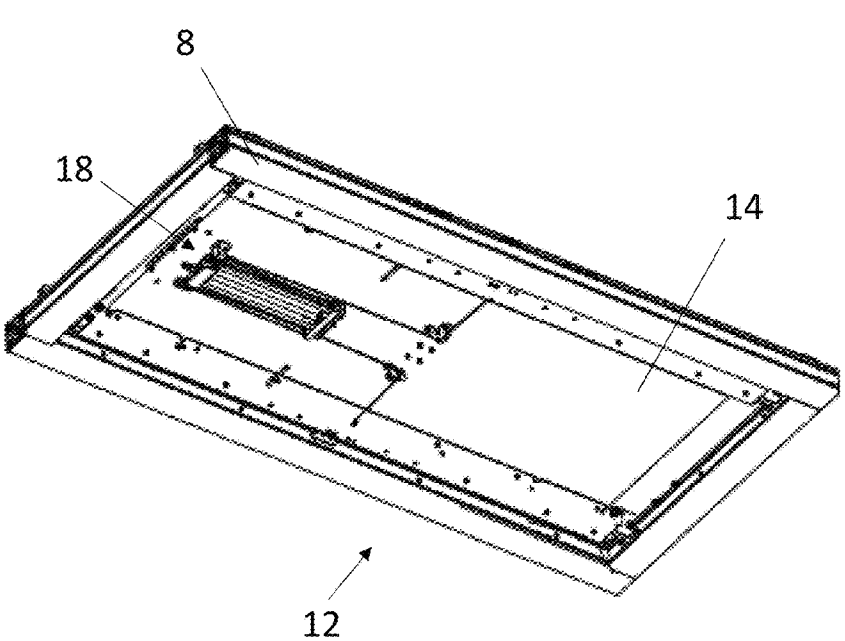
FIG. 6 is a perspective view of a working platform according to this example of the present disclosure, in the stowed position, in which the underside of the working platform is visible.
Figure 5:
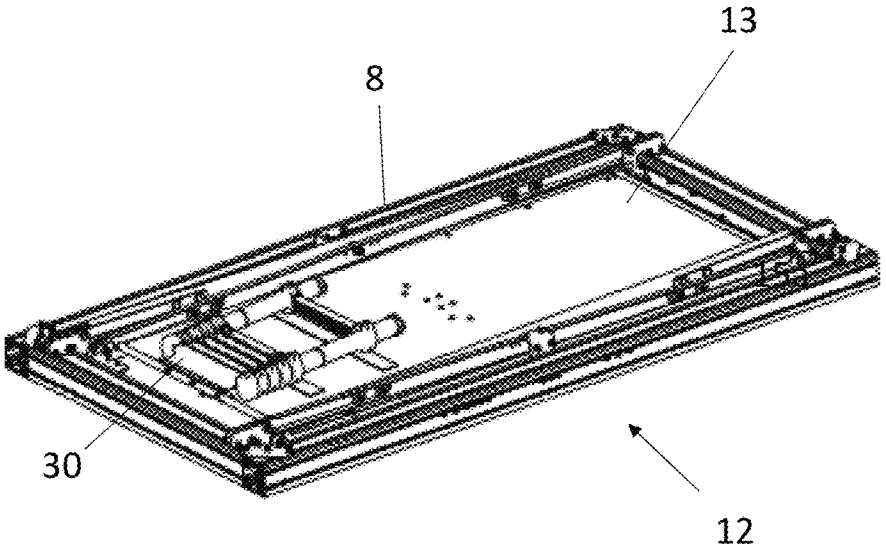
FIG. 5 is a perspective view of a working platform according to this example of the present disclosure, in the stowed position, in which the top surface of the working platform is visible.

FIGS. 5 and 6 show the working platform 12 according to the present disclosure, in the stowed position. In FIG. 5 the top surface 13 of the working platform 12 is visible, in FIG. 6 the underside 14 of the working platform 12 is visible.

Figure 7:
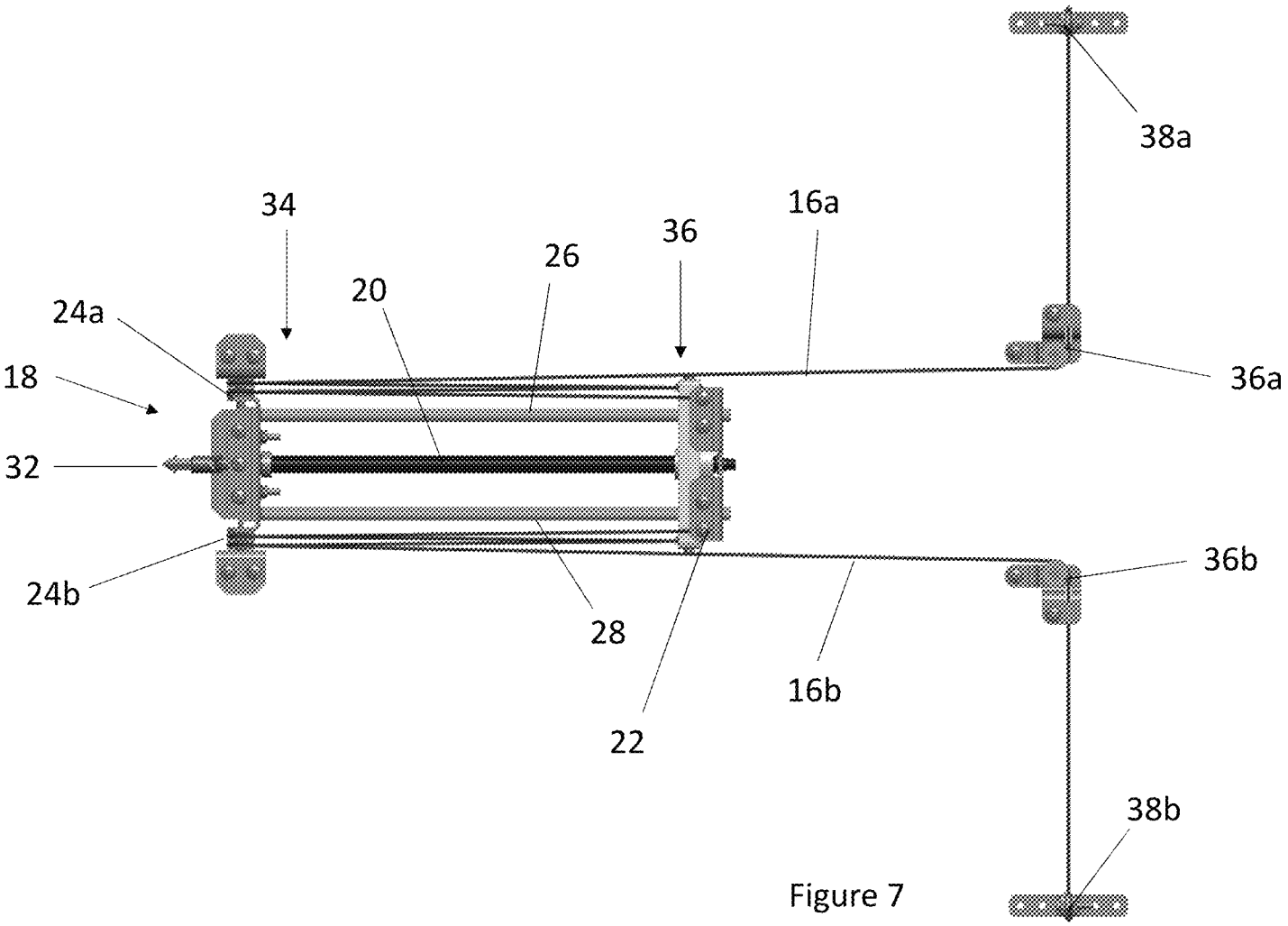
FIG. 7 is a plan view of the hoisting device according to this example of the present disclosure, when the working platform is in the stowed position.

FIG. 7 shows the arrangement of the hoisting device 18 when the working platform 12 is in the stowed position, as shown in FIGS. 5 and 6. The same components are labelled as in FIG. 4. As shown, when the working platform 12 is in the stowed position, the sliding member 22 is close to a second end 36 of the worm screw 20, the end which is further from the first and second deflection sheaves 24*a*, 24*b*. Thus, the tension members 16*a*, 16*b* pass around their respective deflection sheaves 24*a*, 24*b*, and pass back and forth between these deflection sheaves 24*a*, 24*b* and the sliding member 22. In the example as shown, the roping arrangement is 3:1, such that each tension member 16*a*, 16*b* passes back and forth between the deflecting sheave 24*a*, 24*b* and the sliding member 22 three times. This means that the length of the suspending portion of the tension member 17*a*, 17*b* (not shown in FIG. 7) will have been reduced by three times the length of the distance between the respective deflection sheave 24*a*, 24*b* and the sliding member 22. Thus, in the stowed position as shown in FIG. 7, a large length of each tension member 16*a*, 16*b* is 'gathered' between the sliding member 22 and the deflection sheaves 24*a*, 24*b*, meaning that the suspending portion 17*a*, 17*b* of the tension member 16*a*, 16*b* is very short.

Figure 8:
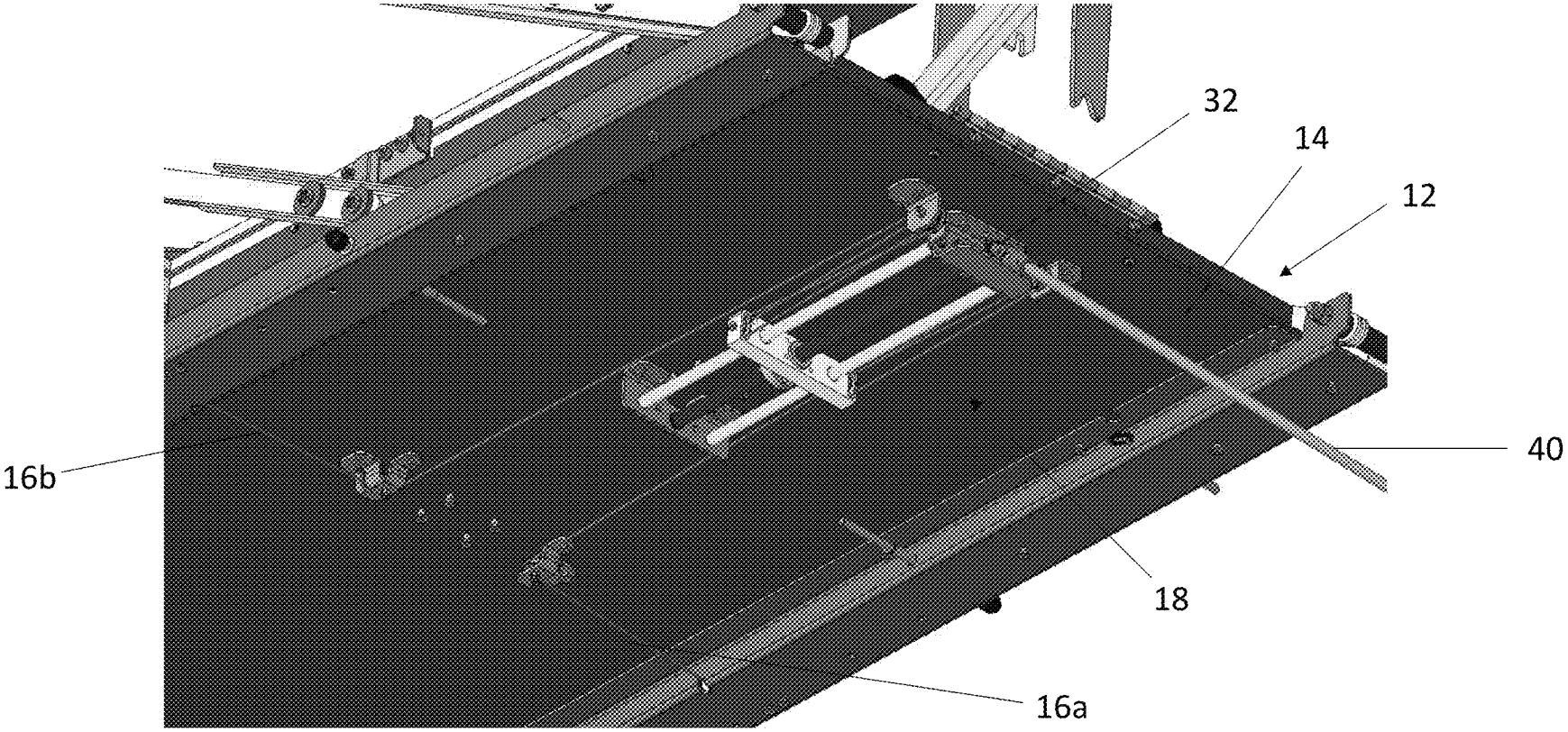
FIG. 8 is a partial perspective view of the underside of the working platform as the working platform is being moved between the operational position and the stowed position, by actuating the hoisting device.

FIG. 8 is a perspective view of the underside 14 of the working platform 12 as the working platform 12 is being moved between the operational position and the stowed position. The working platform 12 is being moved by actuation of the hoisting device 18. The hoisting device 18, specifically the end connection 32, is being rotationally driven using a crank 40. A crank is often provided as a standard tool within an elevator car. However, the crank 40 could instead be replaced by an electric drill, which requires minimal exertion from a maintenance person in order to actuate the hoisting device 18.

Figure 9:
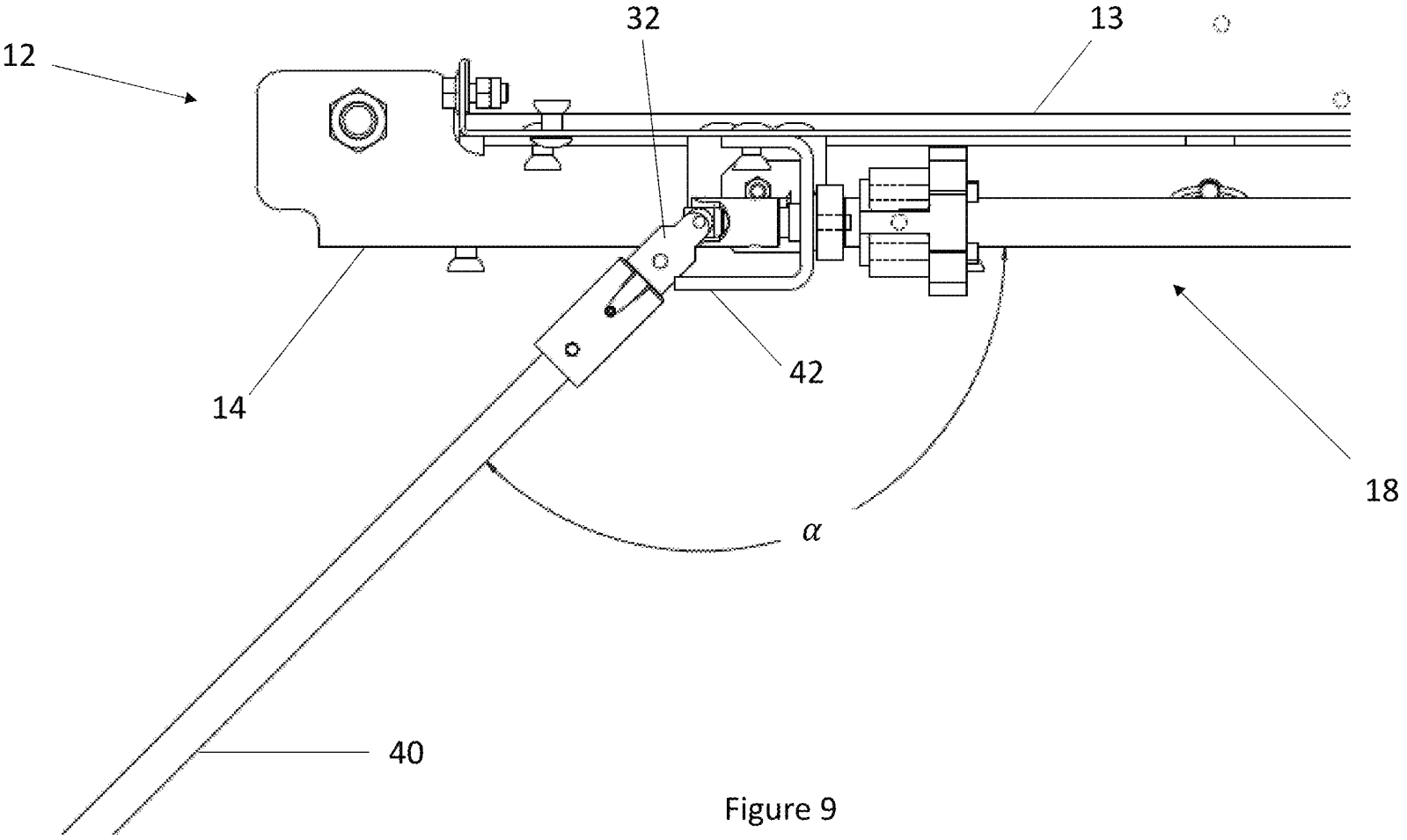
FIG. 9 is a partial side view of the working platform, including the hoisting device and an actuator, as shown in FIG. 8.

FIG. 9 is a side view of the working platform 12, as shown in FIG. 8, including the hoisting device 18 and the crank 40. The hoisting device 18 includes a bracket 42 arranged to limit the angle $\alpha$ at which the crank 40 extends. As shown, the crank 40 extends from the end connection 32 at an angle of a, where a is between approximately 120° and 150°. This helps to protect the technician from harm.

Although the embodiments described above include a hoisting device in the form of a worm screw, it will be appreciated that this mechanism could be replaced by another type of linear drive or any other device that can be operated to change the length of the tension members. For example, a gas spring or reduction gear assembly might be employed instead.

It will be appreciated by those skilled in the art that the disclosure has been illustrated by describing one or more specific examples thereof, but is not limited to these aspects; many variations and modifications are possible, within the scope of the accompanying claims.

What is claimed is:

1. An elevator car (1) defining an interior space (2) for accommodating passengers and/or cargo, the elevator car (1) comprising:

a working platform (12) moveable between a stowed position, above the interior space (2), and an operational position, suspended within the interior space (2);

a hoisting device (18) mounted to the working platform (12);

a tension member (16*a*, 16*b*) connected to the hoisting device (18) and connected to the working platform (12) such that a suspending portion (17*a*, 17*b*) of the tension member (16*a*, 16*b*) suspends the working platform (12), wherein the hoisting device (18) is configured, when actuated, to alter the length of the suspending portion (17*a*, 17*b*), so as to hoist the working platform (12) between the stowed position and the operational position;

wherein the hoisting device (18) is attached to an underside (14) of the working platform (12), the underside of the working platform facing the interior space.

2. The elevator car (1) of claim 1, wherein the hoisting device (18) maintains said suspending portion at a given length, unless actuated by the application of a force.

3. The elevator car (1) of claim 1, wherein the hoisting device (18) is rotationally driven, configured to alter the length of the suspending portion (17*a*, 17*b*).

4. The elevator car (1) of claim 3, wherein the hoisting device (18) comprises a worm screw (20) and a sliding member (22) configured to slide along the worm screw (20) when the worm screw (20) is rotationally driven, wherein the tension member (16*a*, 16*b*) is connected to the sliding member (22), such that when the sliding member (22) moves the length of the suspending portion (17*a*, 17*b*) is altered.

5. The elevator car (1) of claim 1, wherein the hoisting device (18) is manually actuatable.

6. The elevator car (1) of claim 1, wherein the hoisting device (18) comprises at least one deflector (24*a*, 24*b*), and wherein the tension member (16*a*, 16*b*) is arranged to pass over the at least one deflector (24*a*, 24*b*) in a 3:1 roping arrangement.

7. The elevator car (1) of claim 1, further comprising a support frame (8) located at an upper part of the elevator car (1) and a connection mechanism (11), the connection mechanism (11) connected to the support frame (8) and connected to the working platform (12).

8. The elevator car (1) of claim 7, wherein the connection mechanism (11) is arranged to exclusively support the weight of the working platform (12) in the operational position.

9. The elevator car (1) of claim 7, wherein the connection mechanism (11) is a scissor mechanism.

10. The elevator car (1) of claim 9, wherein the tension member (16*a*, 16*b*) passes through an intersection point (15*a*, 15*b*) of the scissor mechanism and connects to the support frame (8).

11. The elevator car (1) of claim 9, wherein the tension member (16*a*, 16*b*) is connected to an intersection point (15*a*, 15*b*) of the scissor mechanism.

12. An elevator system comprising an elevator car (1) according to claim 1.

* * * * *